US006885301B2

(12) United States Patent
Park

(10) Patent No.: US 6,885,301 B2
(45) Date of Patent: Apr. 26, 2005

(54) SECURITY SYSTEM FOR WINDOWS

(75) Inventor: Joung-Seo Park, Incheon (KR)

(73) Assignee: Windowcom E&C Corporation Limited (KR)

( * ) Notice: Subject to any disclaimer, the term of this patent is extended or adjusted under 35 U.S.C. 154(b) by 107 days.

(21) Appl. No.: 10/399,378

(22) PCT Filed: Aug. 6, 2001

(86) PCT No.: PCT/KR01/01332

§ 371 (c)(1),
(2), (4) Date: Apr. 16, 2003

(87) PCT Pub. No.: WO02/45040

PCT Pub. Date: Jun. 6, 2002

(65) Prior Publication Data

US 2004/0012493 A1 Jan. 22, 2004

(30) Foreign Application Priority Data

Nov. 28, 2000 (KR) ..... 2000-33288

(51) Int. Cl.[7] ..... G08B 13/00

(52) U.S. Cl. ..... 340/541; 340/545.1; 160/10; 116/75; 116/86

(58) Field of Search ..... 340/541, 545.1, 340/545.2, 545.3, 545.9; 160/10; 116/75, 86

(56) References Cited

U.S. PATENT DOCUMENTS 4,996,517 A * 2/1991 Kringen et al. ..... 340/506
5,570,079 A * 10/1996 Dockery ..... 340/541
6,317,040 B1 * 11/2001 Ikeda ..... 340/522

* cited by examiner

*Primary Examiner*—Daniel Wu
*Assistant Examiner*—Samuel J. Walk
(74) *Attorney, Agent, or Firm*—Canton Colburn LLP

(57) ABSTRACT

A security system for detecting and expelling external intrusions at individual windows is provided. The security system includes an intrusion detection transmission system (100) having a human body detection sensor (110), an infra-red sensor (120), a switching unit (130) for connecting the detection signals from the sensors (110 and 120), and a wireless transmitter (140) for encoding and wirelessly transmitting the signal transmitted from the switching unit (130), and a central processing system (200) including a wireless receiver (210) for receiving, and demodulating the wireless receiver (210) for receiving and demodulating the wireless transmission signals from the wireless transmitter (140) in the intrusion detection transmission system (100), and a home switching unit (220) for controlling operations of a home automation unit (400) and a warning siren portion (240) according to the outputting signal of the wireless receiver (210). The operation of the central processing system (200) which operates at the time of occurrence of intrusion can be controlled according to the switching operation of a remote controller transmitter (300) which wirelessly transmits a remote controller signal to the wireless receiver (210).

12 Claims, 8 Drawing Sheets

SECURITY SYSTEM FOR WINDOWS

TECHNICAL FIELD

The present invention relates to a security system for windows which are appropriately used for homes or offices, and more particularly, to a security system for windows, in which various kinds of sensors installed at the outside of every window detect external intrusion through a number of windows, generate detection signals, and transmit the detection signals detected by the sensors to an indoor central processing system by wireless transmission and reception, to thereby make the detection signals processed integrally and make alarms to prevent illegal intrusion in advance.

BACKGROUND ART

Windows are made of aluminum or synthetic resin, and used in balcony of apartment houses or office buildings, which are designed to provide a comfortable indoor environment by functions of thermal isolation and noise prevention. However, crimes such as thefts are frequently committed by intrusion through windows other than doors.

In order to prevent instruction through windows, a crime prevention alarming system is required to be installed in windows as well as doors.

There are a variety of known crime prevention alarming systems, which are divided into an on-line realtime supervision system by a crime prevention security service company and a single warning system which is used at an appropriate place by a user.

However, the on-line realtime supervision system has a defect that an economic burden is given to users in which service fees should be paid continuously during contract, while the single warning system limits the supervision area to thereby not realize a highly reliable security system.

In addition, since the conventional security system detects instruction after the instruction occurs through windows, there is a problem that an intrusion cannot be prevented beforehand.

DISCLOSURE OF THE INVENTION

To solve the above problems, it is an object of the present invention to provide a security system which can prevent intrusions which can be committed through a number of windows beforehand.

To accomplish the above object of the present invention, there is provided a security system for detecting external intrusions at individual windows which are constructed in numbers in a building and integrally processing the detected signals to thereby make alarms, the security system comprising: an intrusion detection transmission system provided in each window (WD); a central processing system provided in each home indoor place of the building, for integrally receiving and processing the transmission signals from the intrusion detection transmission system; and a remote controller transmitter for generating and wirelessly transmitting a remote controller signal-for turning on or off operations of the central processing system, wherein said intrusion detection transmission system comprises: a human body detection sensor for detecting heat radiated from an external intruder reaching a window WD; an infra-red sensor having a transmitter for transmitting infra-red light and a receiver for receiving the transmitted infra-red light, both of which are installed in respective outdoor sides of the window WD, for detecting the intruder reaching the window WD; a switching unit having a setting switch so that both a detection setting and a detection release setting are possible according to manipulation of a user, for outputting a detection signal from the human body detection sensor and a detection signal from the infra-red sensor during selection of the detection setting in the setting switch; and a wireless transmitter for wirelessly transmitting the detection signal output from the switching unit, and wherein said central processing system comprises: a wireless receiver for receiving and demodulating the wireless transmission signals from the wireless transmitter which is configured in correspondence to each window WD and the remote controller transmitter for transmitting a user manipulation, and outputting detection signals from the sensors; a home switching unit for connecting the outputting signal of the wireless receiver to a post-end of the home switching unit according to a control mode from the remote controller transmitter; an external connection terminal for connecting the output signal from the home switching unit to an external apparatus; and a warning siren portion for generating a warning siren according to the output signal from the home switching unit.

BRIEF DESCRIPTION OF THE DRAWINGS

The above object and other advantages of the present invention will become more apparent by describing the preferred embodiments thereof in more detail with reference to the accompanying drawings in which.

BEST MODE FOR CARRYING OUT THE INVENTION

A security system according to a preferred embodiment of the present invention will be described below with reference to the accompanying drawings.

Figure 1:
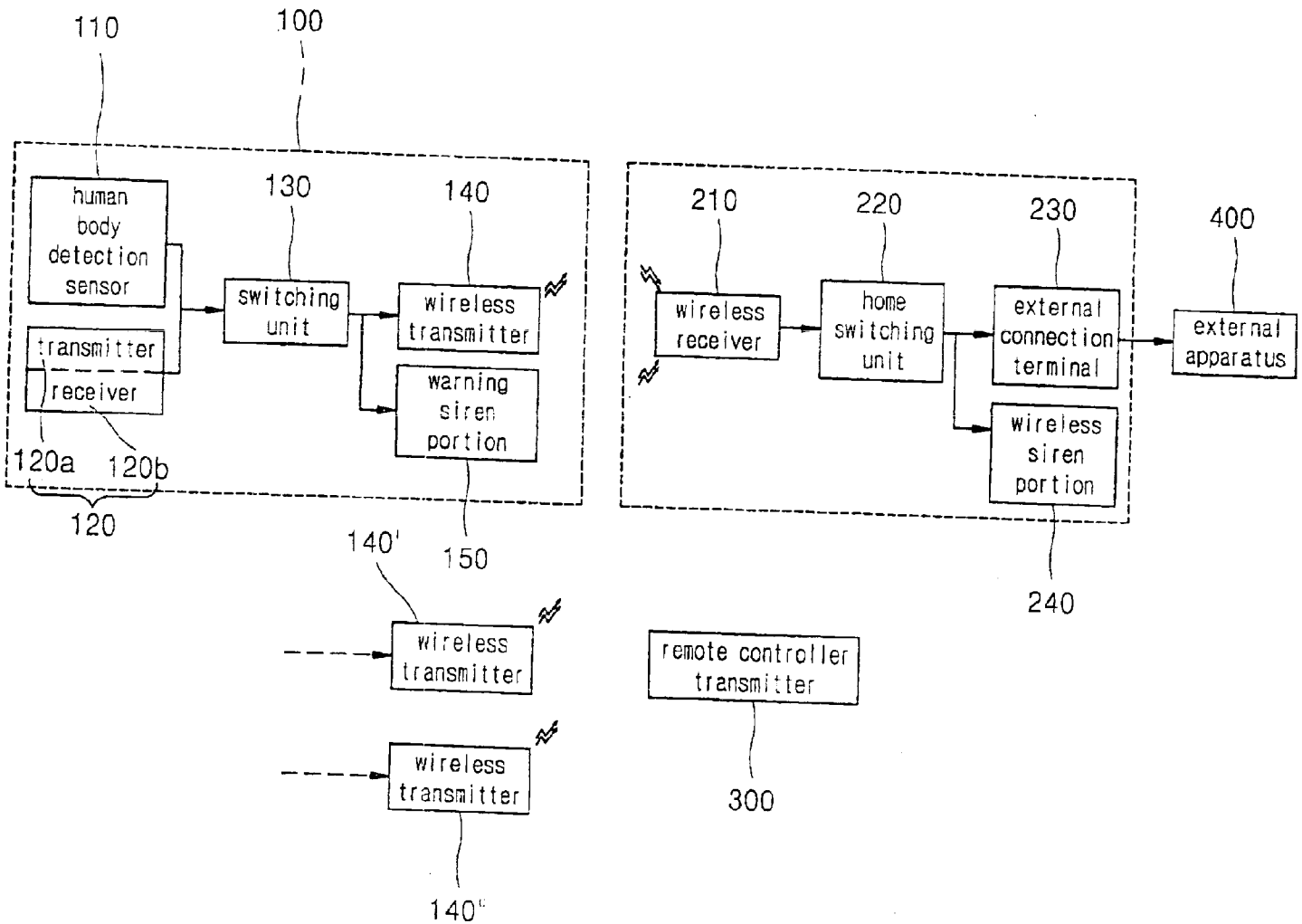
FIG. 1 is a block diagram showing a security system according to the present invention.
Figure 2:
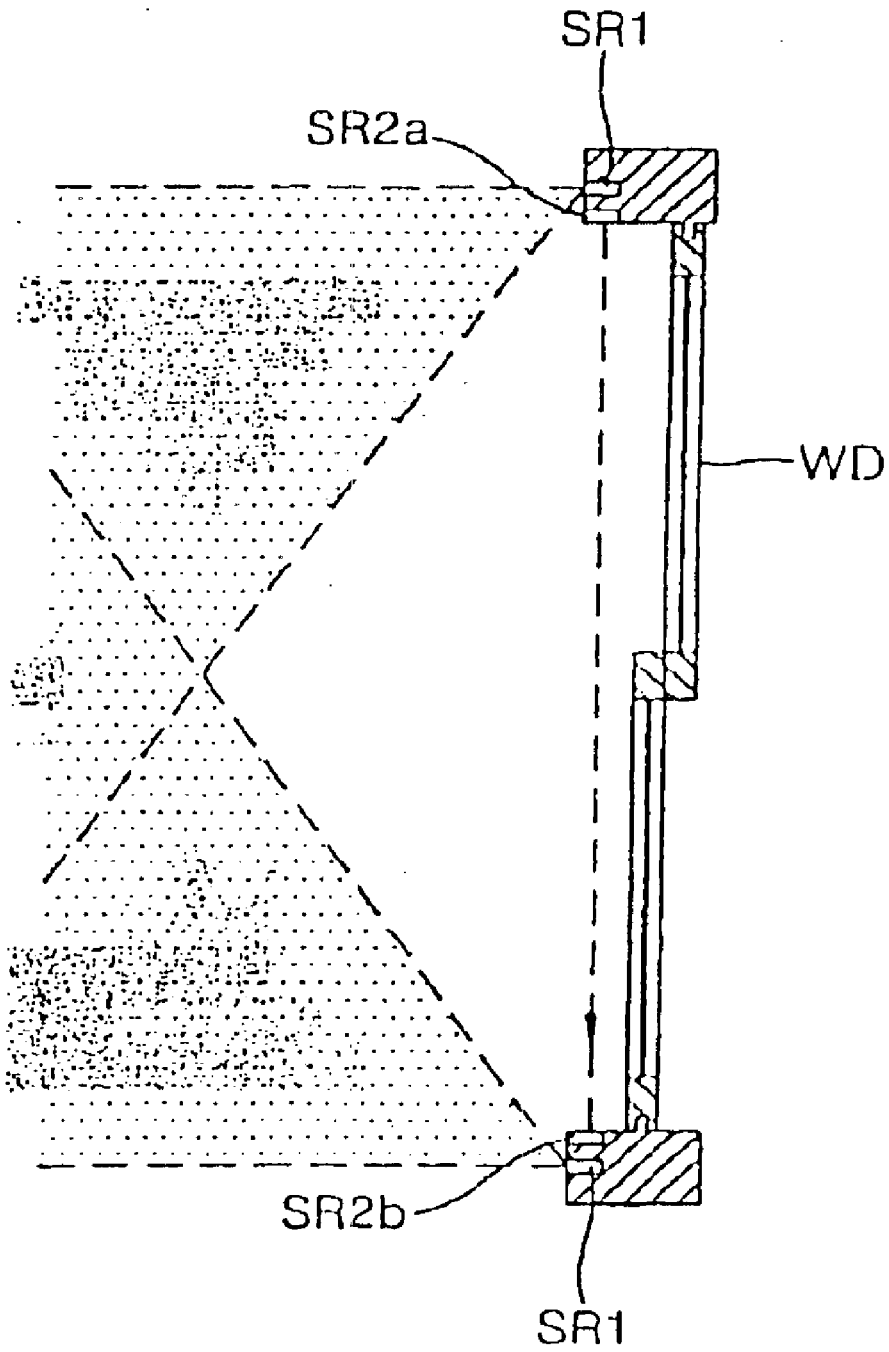
FIG. 2 is a sectional view showing a window on which sensors are installed in the present invention.

Referring to FIGS. 1 and 2, the present invention provides a security system in which external intrusions are detected at individual windows which are constructed in numbers in a building and the detected signals are integrally processed to thereby make alarms. In a security system, an intrusion detection transmission system 100 is provided in each window (WD). A central processing system 200 is provided in each home indoor place of the building in which the transmission signals from the intrusion detection transmission system 100 are integrally received and processed, to thereby make alarms and simultaneously transmit control signals to an external apparatus 400. Also, the security system according to the present invention includes a remote controller transmitter 300 for generating and wirelessly transmitting a remote controller signal for turning on or off operations of the central processing system 200.

The intrusion detection transmission system 100 includes a human body detection sensor 110 for detecting heat radiated from an external intruder reaching a window WD, an infra-red sensor 120 having a transmitter 120*a* for transmitting infra-red light and a receiver 120*b* for receiving the transmitted infra-red light, both of which are installed in respective outdoor sides of the window WD, for detecting the intruder reaching the window WD, a switching unit 130 having a setting switch so that both a detection setting and a detection release setting are possible according to manipulation of a user, for outputting a detection signal from the human body detection sensor 110 and a detection signal from the infra-red sensor 120 during selection of the detection setting in the setting switch, and a wireless transmitter 140 for wirelessly transmitting the detection signal output from the switching unit 130.

The central processing system 200 includes a wireless receiver 210 for receiving and demodulating the wireless transmission signals from the wireless transmitter 140 which is configured in correspondence to each window WD and a remote controller transmitter 300 for transmitting a user manipulation, and outputting detection signals from the sensors 110 and 120, a home switching unit 220 for connecting the outputting signal of the wireless receiver 210 to a post-end of the home switching unit 220 according to a control mode from the remote controller transmitter 300, an external connection terminal 230 for connecting the output signal from the home switching unit 220 to an external apparatus 400 such as a home automation controller, and a warning siren portion 240 for generating a warning siren according to the output signal from the home switching unit 220.

The security system according to the present invention further includes a warning siren portion 150 in the post-end of the switching unit 130, in which case each window WD can generate an individual warning siren.

Figure 3:
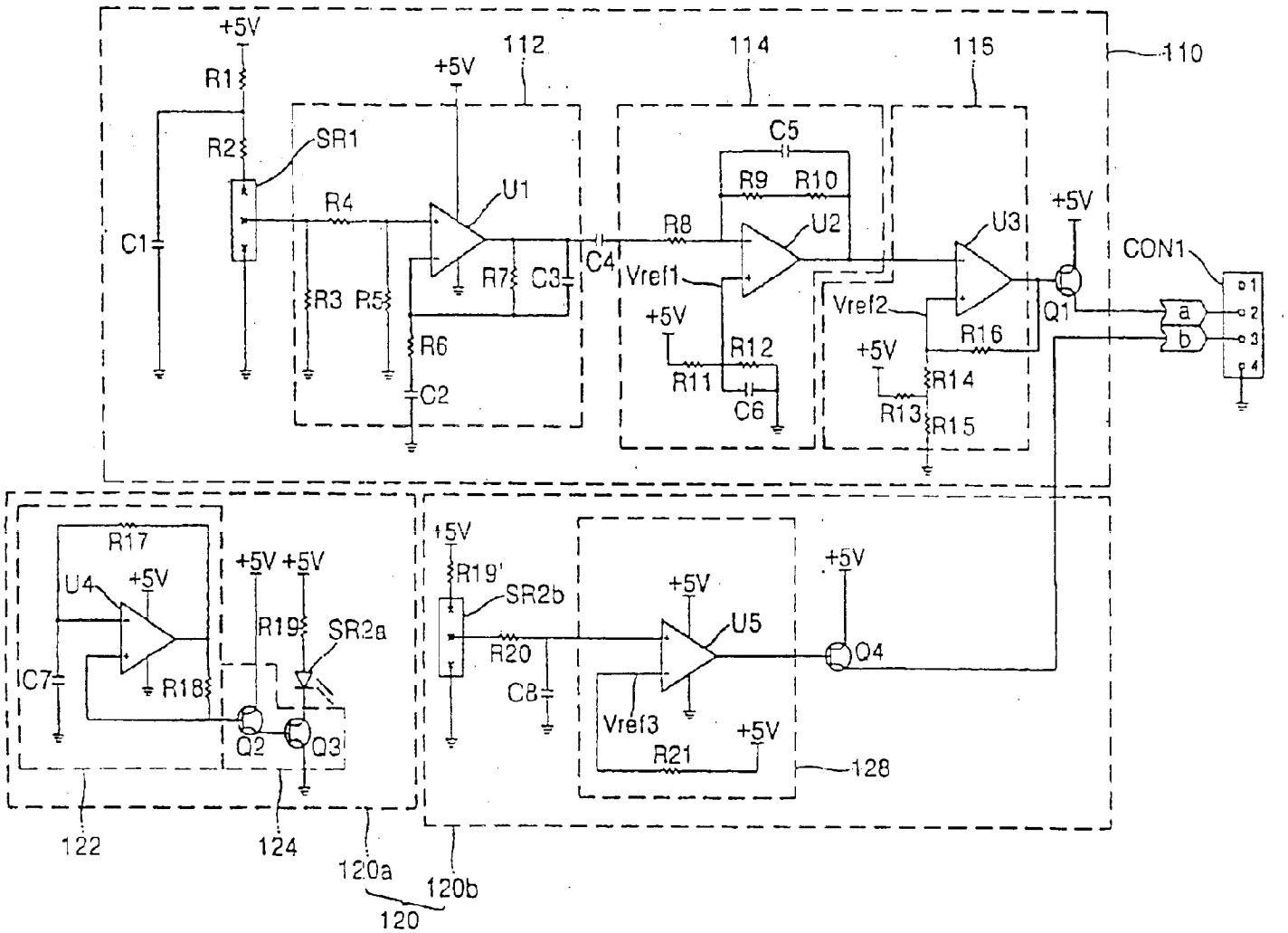
FIG. 3 is a circuitry diagram showing two sensors according to the present invention.

FIG. 3 is a circuitry diagram showing two sensors according to the present invention.

Referring to FIGS. 2 and 3, the circuitry configuration of the human body detection sensor 110 and the infra-red sensor 120 will be described below.

The human body detection sensor 110 includes a pyroelectric sensor SR1 for generating a pulse signal according to detection of a human body temperature, an amplifier 112 for amplifying the output signal from the pyroelectric sensor SR1, a setting voltage outputter 114 for comparing the output signal from the amplifier 112 with a reference voltage Vref1 and outputting a predetermined setting voltage, a comparator 116 for comparing the output voltage from the setting voltage outputter 114 with a reference voltage Vref2 and outputting a stabilized logic signal, and a transistor Q1 for switching a current at a predetermined voltage to a post-end according to the output from the comparator 116. The human body detection sensor 110 is preferably installed by one in both sides of each window WD, that is, by a pair in view of the window size in a conventional building, in order to maintain a detection reliability.

The transmitter 120*a* in the infra-red sensor 120 includes an oscillator 122 for oscillating a predetermined frequency signal of 38 KHz, a current driver 124 for intermittently supplying a current according to the oscillating signal output from the oscillator 122, a light transmission element SR2*a* for transmitting infra-red light of a predetermined wavelength by the current supplied via the current driver 124. The receiver 120*b* in the infra-red sensor 120 includes a light reception element SR2*b* for receiving infra-red light emitted from the light transmission element SR2*a* and outputting an electrical signal proportional with an amount of the received light, and a comparator U5 for comparing the output signal from the light reception element SR2*b* with a reference voltage Vref3 and outputting a logic signal.

Figure 4:
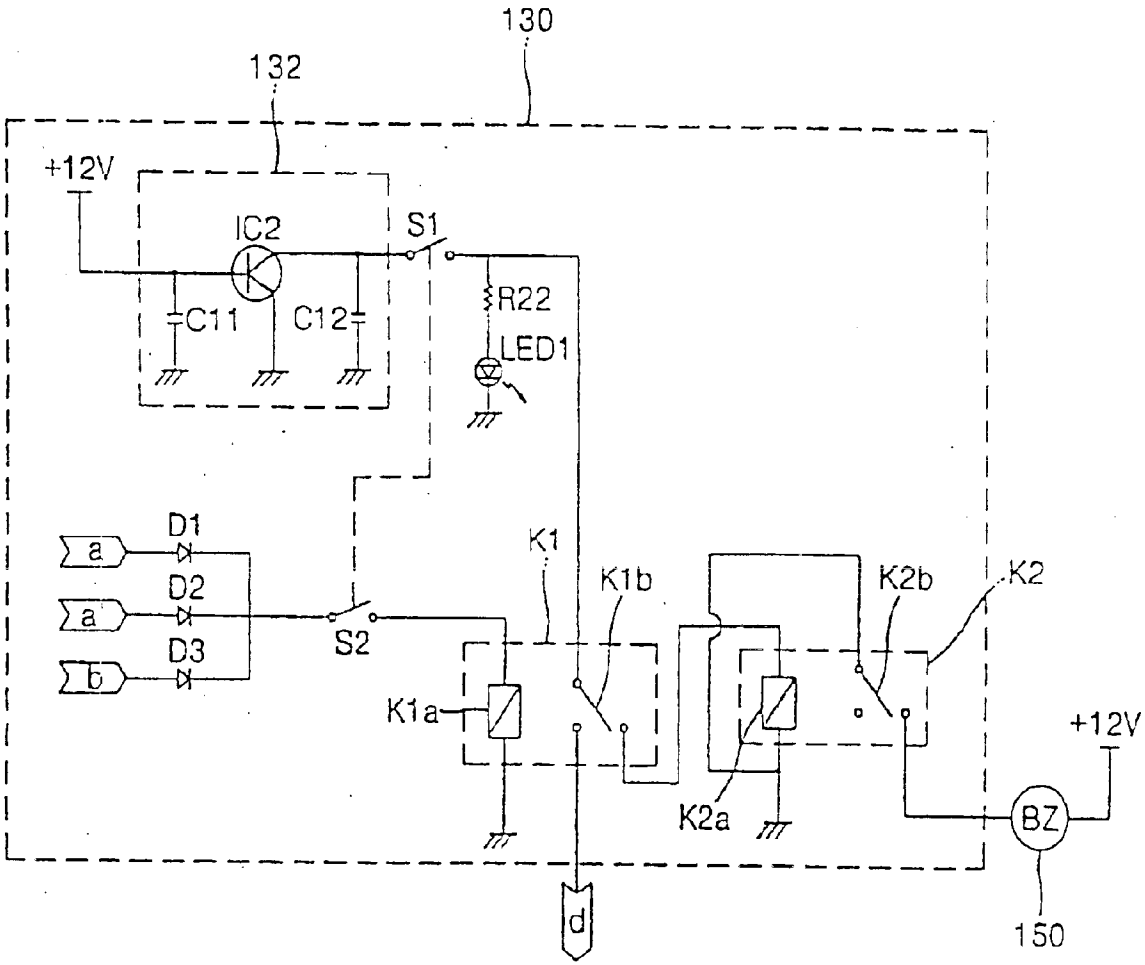
FIG. 4 is a circuitry diagram showing a switching unit according to the present invention.

FIG. 4 is a circuitry diagram showing a switching unit according to the present invention.

Referring to FIG. 4, the switching unit 130 includes a first switch S1 for connecting a main power supply of a transistor-transistor logic (TTL) level output from a constant voltage source 132 to a post-end according to a user manipulation, a second switch S2 for connecting the output signal from the human body detection sensor 110 and the output signal from the infra-red sensor 120 to a post-end according to a user manipulation, and a relay K1 for connecting the power supply supplied via the first switch S1 according to the output signals of the sensors 110*a* and 120 applied via the second switch S2 to the wireless transmitter 140. Meanwhile, in the case that the warning siren portion 150 is provided in the post-end of the switching unit 130 of the intrusion detection transmission system 100, as shown in FIG. 4, a relay K2 for activating a warning siren portion 150 according to the output signals from the sensors 110 and 120 is further provided.

Figure 5:
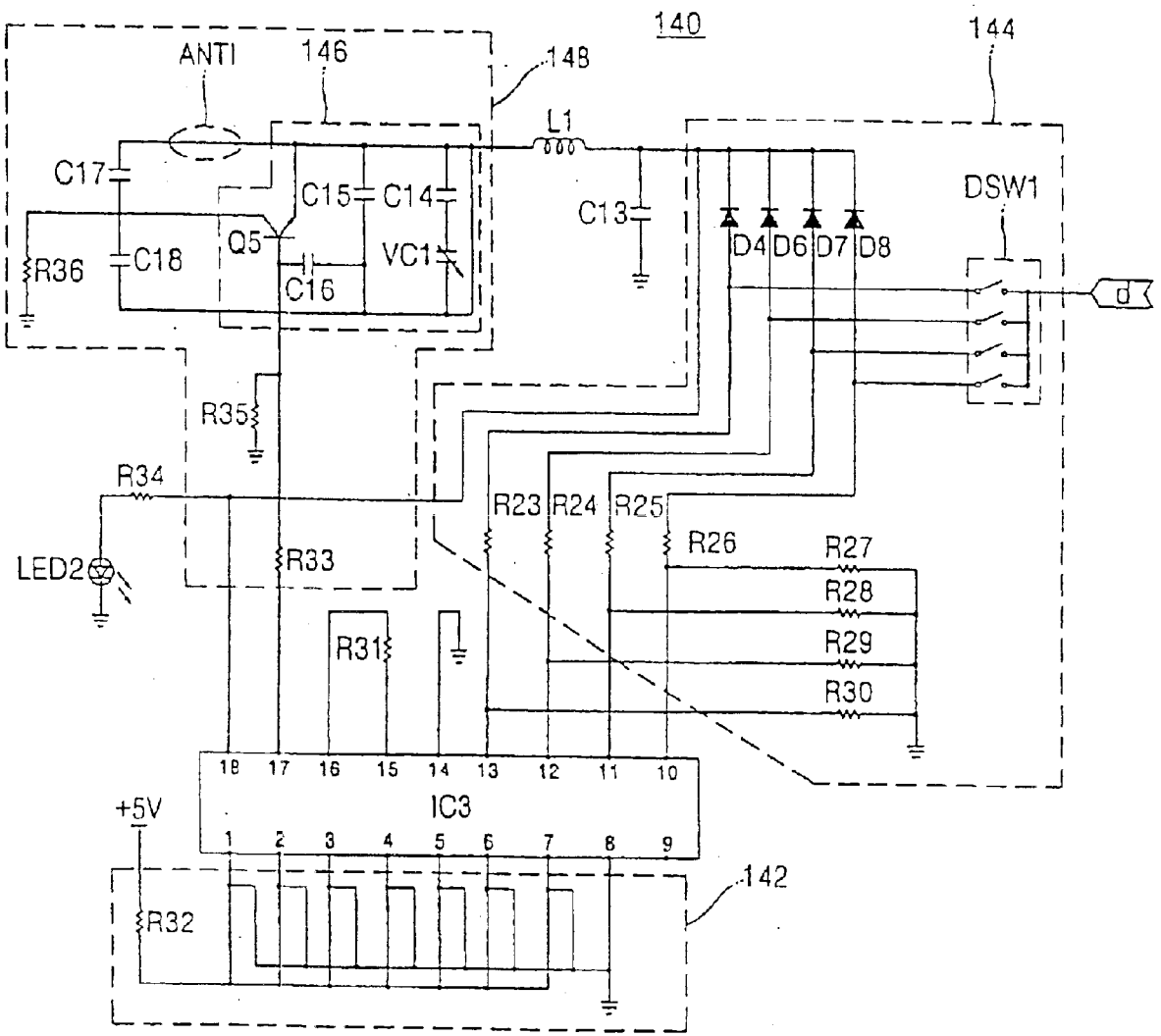
FIG. 5 is a circuitry diagram showing a wireless transmitter according to the present invention.

FIG. 5 is a circuitry diagram showing a wireless transmitter according to the present invention.

Referring to FIG. 5, the wireless transmitter 140 includes an address code generator 142 for generating an address code of a number of bits, a data code generator 144 for generating a data code of a number of bits for transmitting an external intrusion situation according to the detection signal from the switching unit 130, an encoder IC3 combining the data code generated from the data code generator 144 with the address code generated from the address code generator 142 and encoding the combined code, and a high-frequency modulation and transmission unit 148 for modulating the encoded signal with a predetermined high-frequency signal oscillating from the oscillator 146 and wirelessly transmitting the modulated signal via an antenna ANT1. The data code generated from the data code generator 144 can be set by a dip switch DSW1. Instead of the dip switch DSW1, the data code can be set by a soldering connection for making short between bit lines. A reference alphanumeric symbol LED2 denotes a lamp which is turned on according to a signal input from the switching unit 130 when an illegal intrusion occurs.

Figure 6:
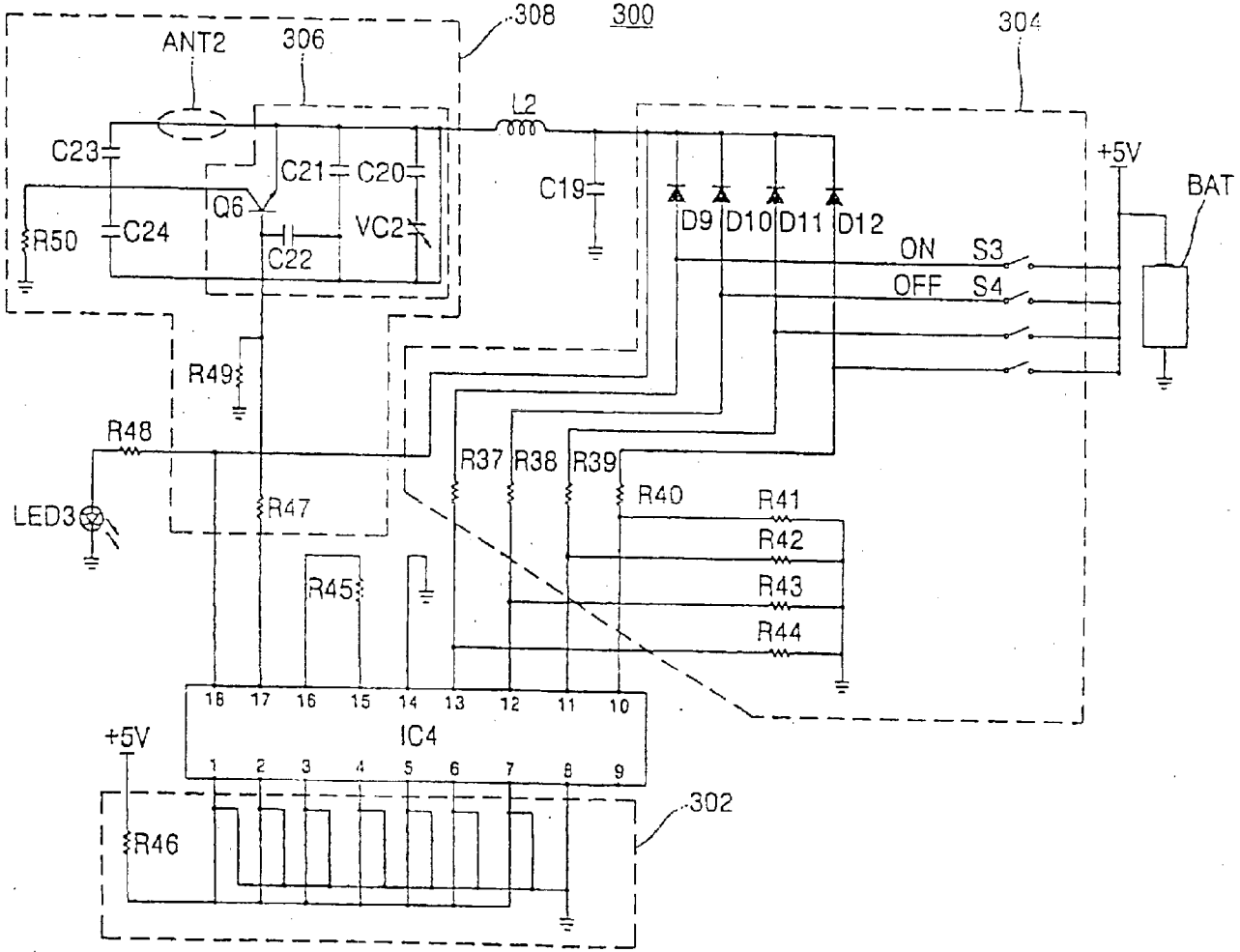
FIG. 6 is a circuitry diagram showing a remote controller transmitter according to the present invention.

FIG. 6 is a circuitry diagram showing a remote controller transmitter according to the present invention.

Referring to FIG. 6, the remote controller transmitter 300 includes an address code generator 302 for generating an address code of a number of bits, a data code generator 304 for generating a data code of a number of bits which can identify remote controller on/off operations according to manipulation of the remote controller switches S3 and S4, an encoder IC4 combining the data code generated from the data code generator 304 with the address code generated from the address code generator 302 and encoding the combined code, and a high-frequency modulation and transmission unit 308 for modulating the encoded signal from the encoder IC4 with a predetermined high-frequency signal oscillating from the oscillator 306 and wirelessly transmitting the modulated signal via an antenna ANT2.

Here, the encoder IC3 in the wireless transmitter 140 and the encoder IC4 in the remote controller transmitter 300 have the same internal diagram. However, the data code of a number of bits input to the encoder IC3 in the wireless transmitter when an illegal external intrusion occurs differs from that input to the encoder IC4 when the on-signal remote controller switch S3 and the off-signal remote controller switch S4 are manipulated. Accordingly, the wireless receiver 210 can identify whether a data code is generated by a remote controller on/off manipulation or an occurrence of intrusion.

Also, the high-frequency signal oscillating in the oscillator 146 in the wireless transmitter 140 and the high-frequency signal oscillating in the oscillator 306 in the remote controller transmitter 300 have the same frequency.

In FIG. 6, a reference symbol BAT denotes a battery, and LED2 denotes a lamp which is turned on according to a signal input due to generation of a data code from the switches S3 and S4 when the remote controller is turned on or off.

Figure 7:
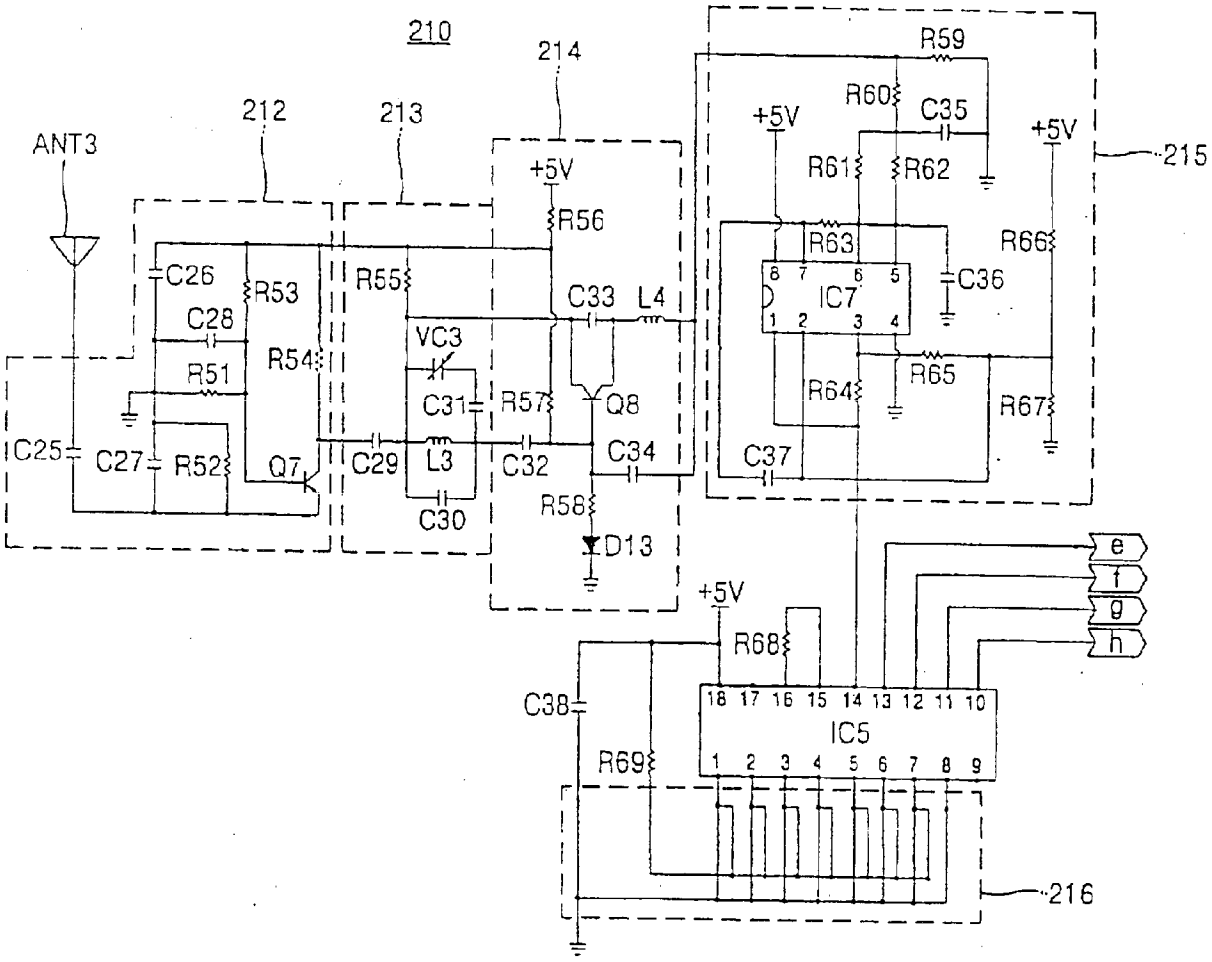
FIG. 7 is a circuitry diagram showing a wireless receiver according to the present invention.

FIG. 7 is a circuitry diagram showing a wireless receiver according to the present invention.

Referring to FIG. 7, the wireless receiver 210 includes a high-frequency amplifier 212 for amplifying a wireless signal received via an antenna ANT3, a tuner 213 for tuning the wireless signal transmitted from the high-frequency modulation and transmission unit 148 in the wireless transmitter 140 and the wireless signal transmitted from the high-frequency modulation and transmission unit 308 in the remote controller transmitter 300, among the amplified signal from the high-frequency amplifier 212, a demodulator 214 for demodulating the signal tuned and output from the tuner 213 and introducing the generated encoded signal to the encoder IC3 in the wireless transmitter 140 and the encoder IC4 in the remote controller transmitter 300, a low-frequency amplifier 215 for amplifying the demodulated encoded signal from the demodulator 214, and a decoder IC5 for decoding the amplified encoded signal from the low-frequency amplifier 215 based on an address code generated in an address code generator 216, and outputting a warning signal for notifying an external intrusion situation according to presence or absence of the data code generated from the data code generator 144 in the wireless transmitter 140 and simultaneously outputting a remote controller manipulation signal for notifying a remote controller turn-on or turn-off state according to presence or absence of the data code generated from the data code generator 304 in the remote controller transmitter 300.

Figure 8:
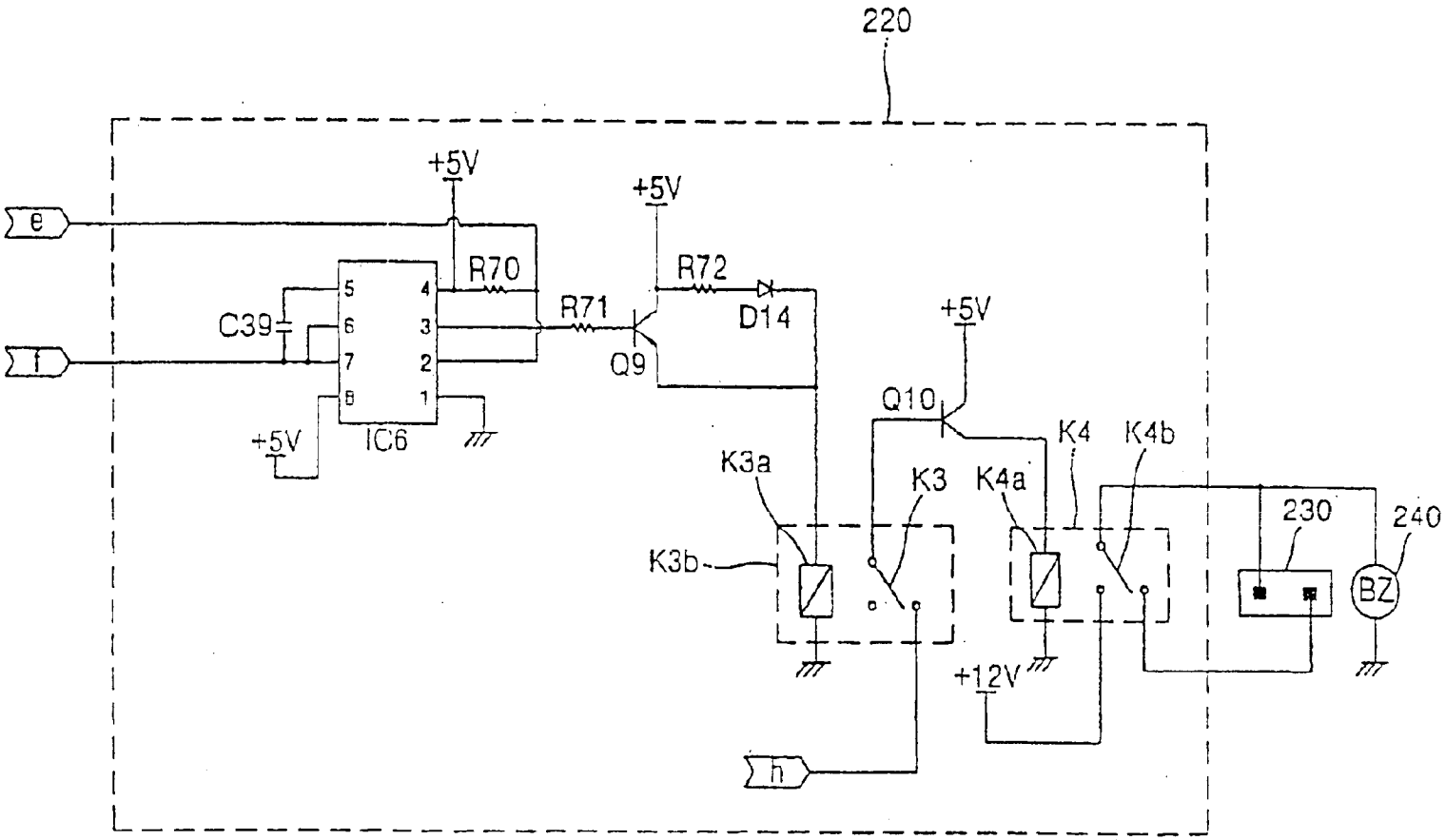
FIG. 8 is a circuitry diagram showing a home switching unit according to the present invention.

FIG. 8 is a circuitry diagram showing a home switching unit according to the present invention.

Referring to FIG. 8, the home switching unit 220 includes a relay K3 for respectively connecting and disconnecting the central processing system 200 to and from an external apparatus 400 according to an output signal for notifying an external intrusion situation output from the decoder IC5 in the wireless receiver 210 according to the remote controller manipulation signal output from the decoder IC5 in the wireless receiver 210. Meanwhile, in the case that the warning siren portion 240 is provided in the post-end of the home switching unit 220 in the central processing system 200, as shown in FIG. 8, a relay K4 for activating an external outputter 230 and a warning siren portion 240 according to the output signals from the sensors 110 and 120 is further provided.

The functions and effects of the present invention having the above-described configuration will be described in more detail with reference to the accompanying drawings.

First, in the case that there are no intruders in the neighborhood of windows WD, a pyroelectric sensor SR1 in a human body detection sensor 110 shown in FIGS. 2 and 3 generates a very feeble electrical signal. Accordingly, a signal voltage applied to a setting voltage outputter 114 via the amplifier 112 is also feeble. Thus, the setting voltage outputter 114 outputs a low level signal. As a result, the output from a comparator 116 becomes a low level and the voltage of the output end "a" connected to the emitter electrode of a turned-off transistor Q1 becomes a low level.

Meanwhile, if an intruder approaches a window, the pyroelectric sensor SR1 in the human body detection sensor 10 detects heat emitted from the human body of the approaching intruder and outputs an electrical signal. The electrical signal is input to the non-inverting end of an OP amplifier U1 in an amplifier 112 connected to the post-end of the pyroelectric sensor SR1, and then amplified and outputted at a high gain as many as a gain set by resisters R6 and R7 connected to the inverting end of the OP amplifier U1. Then, the high gain amplified output signal is input to the inverting end of a comparator U2 in the setting voltage outputter 114 via a coupling capacitor C4. In the case that the input signal is greater than a reference voltage Vref1 applied to the non-inverting end of the comparator U2 since an intruder has been detected, the comparator U2 outputs a fixed voltage amplified as many as a gain set by feedback loop resisters R9 and R10 and a capacitor C5. Since the output voltage from the comparator U2 is greater than a reference voltage Vref2 input to the inverting end of a comparator U3 forming a comparison unit 116, the comparator U3 outputs a high level signal and thus makes a transistor Q1 turned on. Accordingly, the collector voltage of the transistor Q1 electrifies the emitter electrode of the transistor Q1 and thus the voltage of the output end "a" connected to the emitter electrode thereof becomes a high level.

Meanwhile, in the case that an intruder destroys an window or approaches a window very closely, the infrared light emitted from a light transmission device SR2*a* in a transmitter 120*a* of an infrared sensor 120 and then received by a light reception device SR2*b* in a receiver 120*b* is intercepted by the destroyed window or the human body of the intruder. Accordingly, the light reception device SR2*b* outputs a low level signal and then applies it to the non-inverting end of a comparator U5. Since the low level signal applied to the non-inverting end of the comparator U5 is lower than a reference voltage Vref3 input to the inverting end of the comparator U5, the comparator U5 outputs a high level signal and thus makes a transistor Q4 turned on. Accordingly, the voltage of the output end "b" connected to the emitter electrode of the transistor Q4 becomes a high level by the voltage having electrified the transistor Q4.

For convenience of understanding of the connections between the drawings, the output ends outputting the signals and the input ends receiving the outputting signals are assigned by the same reference characters.

The signals of the output ends "a" and "b" in the sensors 110 and 120 are input to the input ends "a" and "b" in the switching unit 130 shown in FIG. 4. The output signal from a second human body detection sensor 110' (not shown) is input to the input end in the switching unit 130. As described in the human body detection sensor, the second human body detection sensor 110' is one of the two human body detection sensors installed in the window WD.

These signals are applied to one end of a switch S2 via diodes D1, D2 and D3 which are forwardly connected. In the case that any one of the signals from the sensors 110, 110' and 120 is a high level, a signal applied to the switch S2 becomes a high level. The high level signal magnetizes a coil K1*a* in a relay K1 at the turn-on state of the switch S2 and makes a moving contact K1*b* turned on. Accordingly, the output voltage from a constant voltage circuit 132 which converts a direct current (DC) 12V input into a constant voltage of DC 5V of a TTL (transistor-transistor-logic) level passes through the moving contact K1*b* in the relay K1 and is applied to a dip switch DSW1 in a data code generator 144 forming a wireless transmitter 140 shown in FIG. 5 as a high level logic signal via the output end "d."

Meanwhile, in FIG. 4, in the case that the warning siren portion 150 is provided in the post-end of the switching unit 130 of the intrusion detection transmission system 100, a relay K2 for activating a warning siren portion (BZ; buzzer) 150 according to the output signals from the sensors 110 and 120 is further provided. Here, a coil K2*a* in the relay K2 activating when the relay K1 is turned on is not magnetized and thus a moving contact K2*b* in the relay K2 is turned off and the warning siren portion 150 is activated. When the relay K1 is turned off, the coil K2*a* in the relay K2 is magnetized and thus the moving contact K2*b* is turned on and the warning siren portion 150 is not activated.

The dip switch DSW1 in the data code generator 144 can change logic levels input to the 10th, 11th, 12th and 13th pins (10, 11, 12 and 13) of an encoder IC3 according to a setting state thereof, to thereby generate four-bit code data.

An address code generator 142 in the wireless transmitter 140 generates a predetermined address code based on the connection states of the 1st to 8th pins in the encoder IC3. The encoder IC3 combines the address code and the data code and outputs the generated encoded signal via a 17th pin and thus applies it the base electrode of a transistor Q5 forming a high-frequency modulation and transmission unit 148. The high-frequency modulation and transmission unit 148 modulates the encoded signal output from the encoder IC3 with a high-frequency signal oscillating in an oscillator 146 and wirelessly transmits the modulated result via an antenna ANT1. The oscillator 146 oscillates a high-frequency signal of a carrier frequency by a number of capacitors C14, C15, C16 and VC1 connected between the emitter electrode and the base electrode of the transistor Q5, and can variably control the carrier frequency by the variable capacitor VC1.

The operation of transmitting a wireless signal in a remote controller transmitter 300 shown in FIG. 6 is similar to that of the wireless transmitter 140. Here, a data code for identifying a remote controller operation differs from the data code generated at the time of occurrence of intrusion.

As described above, the wireless signal transmitted from the wireless transmitter 140 or the wireless signal transmitted from the remote controller transmitter 300 is received via an antenna ANT3 in the wireless receiver 210 shown in FIG. 7, amplified in a high-frequency amplifier 212, tunes in a tuner 213, and demodulated in a demodulator 214. The demodulated signal is amplified in a low-frequency amplifier 215 and then input to the 14th pin in a decoder IC5.

The decoder IC5 decodes the input encoded signal with the address code generated in the address code generator 216 and outputs a signal for notifying an external intrusion situation via the output end "h" thereof according to presence or absence of the data code generated in the data code generator 144 in the wireless transmitter 140. Also, the decoder IC5 outputs a remote controller operation signal for notifying turn-on and turn-off operations of the remote controller via the output ends "e" and "f" according to presence and absence of the data code generated in the data code generator 304 in the remote controller transmitter 300.

The remote controller turn-on signal among the output signals from the decoder IC5 is input to the 2nd pin of a timer integrated circuit (IC) device IC6 via the output end "e" and the remote controller turn-off signal thereof is input to the 5th, 6th and 7th pins of the timer IC device IC6 forming a home switch unit 220 shown in FIG. 8 via the output end "f."

In the case that a remote controller turn-on signal is input, the timer IC device IC6 outputs a low level signal via the 3rd pin thereof, and thus makes a transistor Q9 turned off. Accordingly, a moving contact K3*a* in a relay K3 makes an intrusion warning signal output via the output end "h" in the wireless receiver 210 applied to the base electrode of a transistor Q10 and makes the transistor Q10 turned on. Thus, a moving contact K4*b* in a relay K4 is turned on and makes a DC 12V power to a warning siren portion 240 and one end of an external connector 230 connected to a home automation unit which is an external apparatus 400. As a result, a warning siren for notifying an external intrusion occurs, and a predetermined operation against the intrusion is done in the home automation unit.

Also, in the case that a remote controller turn-off signal is input via the 7th pin thereof, the timer IC device IC6 outputs a high level signal via the 3rd pin and makes the transistor Q9 turned on. Accordingly, the output signal from the wireless receiver 210 applied to the base electrode of the transistor Q10 via the moving contact K3*a* in the relay K3 is disconnected. As a result, the warning siren generated from the warning siren portion 240 is interrupted and simultaneously both ends of the external connector 230 are short-circuited to thereby interrupt an operation of the home automation unit such as a buzzer (BZ) 240.

Meanwhile, in the case that a warning signal for notifying an occurrence of intrusion via the output end "h" in the wireless receiver is not input to the relay K3 in the home switching unit 220, the warning siren portion and the home automation unit do not operate.

As described above, the security system according to the present invention detects an external intruder who intends to intrude through a window in an apartment house or building at an initial time before he or she passes through the window, and outputs a warning signal to expel the intruder. In particular, the detection signals from the sensors installed in each window are integrally processed in a central processing system, to thereby activate a warning siren portion and a home automation unit, and thus realize a crime prevention function having a higher reliability than an individually installed security system.

The present invention is not limited in the above-described embodiment. It is apparent to one who is skilled in the art that there are many variations and modifications.

INDUSTRIAL APPLICABILITY

As described above, the security system according to the present invention can be installed in each window in an apartment house or office building, to prevent an intended intrusion in advance and thus provide a higher reliable security system.

What is claimed is:

1. A security system for detecting external intrusions at individual windows which are constructed in numbers in a building and integrally processing the detected signals to thereby make alarms, the security system comprising:

an intrusion detection transmission system (100) provided in each window (WD);

a central processing system (200) provided in each home indoor place of the building, for integrally receiving and processing the transmission signals from the intrusion detection transmission system (100); and a remote controller transmitter (300) for generating and Tirelessly transmitting a remote controller signal for turning on or off operations of the central processing system (200), wherein said intrusion detection transmission system (100) comprises:

a human body detection sensor (110) for detecting heat radiated from an external intruder reaching a window (WD);

an infra-red sensor (120) having a transmitter (120*a*) for transmitting infra-red light and a receiver (120*b*) for receiving the transmitted infra-red light, both of which are installed in respective outdoor sides of the window (WD), for detecting the intruder reaching the window (WD);

a switching unit (130) having a setting switch so that both a detection setting and a detection release setting are possible according to manipulation of a user, for outputting a detection signal from the human body detection sensor (110) and a detection signal from the infra-red sensor (120) during selection of the detection setting in the setting switch; and a wireless transmitter (140) for wirelessly transmitting the detection signal output from the switching unit (130), and wherein said central processing system (200) comprises:

a wireless receiver (210) for receiving and demodulating the wireless transmission signals from the wireless transmitter (140) which is configured in correspondence to each window (WD) and the remote controller transmitter (300) for transmitting a user manipulation, and outputting detection signals from the sensors (110 and 120);

a home switching unit (220) for connecting the outputting signal of the wireless receiver (210) to a post-end of the home switching unit (220) according to a control mode from the remote controller transmitter (300);

an external connection terminal (230) for connecting the output signal from the home switching unit (220) to an external apparatus (400); and a warning siren portion (240) for generating a warning siren according to the output signal from the home switching unit (220).

2. The security system of claim 1, wherein said human body detection sensor (110) comprises:

a pyroelectric sensor (SR1) for generating a pulse signal according to detection of a human body temperature;

an amplifier (112) for amplifying the output signal from the pyroelectric sensor (SR1);

a setting voltage outputter (114) for comparing the output signal from the amplifier (112) with a reference voltage (Vref1) and outputting a predetermined setting voltage;

a comparator (116) for comparing the output voltage from the setting voltage outputter (114) with a reference voltage (Vref2) and outputting a stabilized logic signal; and a transistor (Q1) for switching a current at a predetermined voltage to a post-end according to the output from the comparator (116).

3. The security system of claim 1, wherein the transmitter (120*a*) in said infra-red sensor (120) comprises:

an oscillator (122) for oscillating a predetermined frequency signal of 38 KHz;

a current driver (124) for intermittently supplying a current according to the oscillating signal output from the oscillator (122); and a light transmission element (SR2*a*) for transmitting infra-red light of a predetermined wavelength by the current supplied via the current driver (124), and wherein the receiver (120*b*) in said infra-red sensor (120) comprises:

a light reception element (SR2*b*) for receiving infra-red light emitted from the light transmission element (SR2*a*) and outputting an electrical signal proportional with an amount of the received light; and a comparator (U5) for comparing the output signal from the light reception element SR2*b* with a reference voltage (Vref3) and outputting a logic signal.

4. The security system of claim 1, wherein said switching unit (130) comprises:

a first switch (S1) for connecting a main power supply of a transistor-transistor logic (TTL) level output from a constant voltage source (132) to a post-end according to a user manipulation;

a second switch (S2) for connecting the output signal from the human body detection sensor (110) and the output signal from the infra-red sensor (120) to a post-end according to a user manipulation; and a relay (K1) for connecting the power supply supplied via the first switch (S1) according to the output signals of the sensors (110*a* and 120) applied via the second switch (S2) to the wireless transmitter (140).

5. The security system of claim 1, wherein said wireless transmitter (140) comprises:

an address code generator (142) for generating an address code of a number of bits;

a data code generator (144) for generating a data code of a number of bits for transmitting an external intrusion situation according to the detection signal from the switching unit (130);

an encoder (IC3) combining the data code generated from the data code generator (144) with the address code generated from the address code generator (142) and encoding the combined code; and a high-frequency modulation and transmission unit (148) for modulating the encoded signal with a predetermined high-frequency signal oscillating from the oscillator (146) and wirelessly transmitting the modulated signal via an antenna (ANT1).

6. The security system of claim 5, wherein said remote controller transmitter (300) comprises:

an address code generator (302) for generating an address code of a number of bits;

a data code generator (304) for generating a data code of a number of bits which can identify remote controller turn-on/turn-off operations according to manipulation of the remote controller switches (S3) and (S4);

an encoder (IC4) combining the data code generated from the data code generator (304) with the address code generated from the address code generator (302) and encoding the combined code; and a high-frequency modulation and transmission unit (308) for modulating the encoded signal from the encoder (IC4) with a predetermined high-frequency signal oscillating from the oscillator (306) and wirelessly transmitting the modulated signal via an antenna (ANT2).

7. The security system of claim 6, wherein said wireless receiver (210) comprises:

a high-frequency amplifier (212) for amplifying a wireless signal received via an antenna (ANT3);

a tuner (213) for tuning the wireless signal transmitted from the high-frequency modulation and transmission unit (148) in the wireless transmitter (140) and the wireless signal transmitted from the high-frequency modulation and transmission unit (308) in the remote controller transmitter (300), among the amplified signal from the high-frequency amplifier (212);

a demodulator (214) for demodulating the signal tuned and output from the tuner (213) and introducing the generated encoded signal to the encoder (IC3) in the wireless transmitter (140) and the encoder (IC4) in the remote controller transmitter (300);

a low-frequency amplifier (215) for amplifying the demodulated encoded signal from the demodulator (214); and a decoder (IC5) for decoding the amplified encoded signal from the low-frequency amplifier (215) based on an address code generated in an address code generator (216), and outputting a warning signal for notifying an external intrusion situation according to presence or absence of the data code generated from the data code generator (144) in the wireless transmitter (140) and simultaneously outputting a remote controller manipulation signal for notifying a remote controller turn-on or turn-off state according to presence or absence of the data code generated from the data code generator (304) in the remote controller transmitter (300).

8. The security system of claim 7, wherein said home switching unit (220) comprises:

a relay (K3) for respectively connecting and disconnecting the central processing system (200) to and from an external apparatus (400) according to an output signal for notifying an external intrusion situation output from the decoder (IC5) in the wireless receiver (210) according to the remote controller manipulation signal output from the decoder (IC5) in the wireless receiver (210).

9. The security system of claim 7, wherein the high-frequency signal oscillating in the oscillator (146) in said wireless transmitter (140) and that of the high-frequency signal oscillator in the oscillator (306) in the remote controller transmitter (300) have the same frequency.

10. The security system of claim 1, further comprising a warning siren portion (150) generating a warning signal according to the output signal from said switching unit (130).

11. The security system of claim 1, wherein said human body detection sensor (110) is installed in pair per each window (WD).

12. The security system of claim 8, wherein said external apparatus (400) is a home automation unit.

* * * * *